United States Patent [19]

Haber

[11] Patent Number: 4,733,797

[45] Date of Patent: Mar. 29, 1988

[54] DOSAGE SEALING, MONITORING AND DISPENSING ASSEMBLY

[76] Inventor: Terry M. Haber, 25011 Castlewood, Lake Forest, Calif. 92630

[21] Appl. No.: 909,559

[22] Filed: Sep. 22, 1986

[51] Int. Cl.[4] ..... G07F 11/00

[52] U.S. Cl. ..... 221/8; 221/25; 221/31; 221/74; 221/131; 221/283

[58] Field of Search ..... 221/30–32, 221/25, 2, 4, 5, 8, 70–72, 74, 78, 81, 282, 283, 232, 197, 131; 206/531, 532, 534

[56] References Cited

U.S. PATENT DOCUMENTS

| | | | |
|---|---|---|---|
| 647,955 | 4/1900 | Fonsskov | 221/232 |
| 1,319,084 | 10/1919 | Hume | 221/232 |
| 3,566,732 | 3/1971 | Haster et al. | 221/71 |
| 3,651,927 | 3/1972 | Richardson et al. | 221/5 |
| 3,817,422 | 6/1974 | Raitt | 221/74 |
| 4,176,762 | 12/1979 | Scalera et al. | 221/81 |

*Primary Examiner*—H. Grant Skaggs
*Attorney, Agent, or Firm*—Morland C. Fischer

[57] ABSTRACT

A dosage sealing, monitoring and dispensing assembly including a mounting receptacle and one or more cartridges removably connected to the receptacle. Each cartridge has sealed therewithin a fresh, supply of dosage units (e.g. medicine or vitamins) carried in moisture impervious shells on a flexible, segmented strip. The strip contains a predetermined number of dosage units to be consumed by the user over a particular duration. Each cartridge also has mechanical linkage by which a dosage unit can be automatically removed from its shell on the strip and delivered to the user by way of a trough formed in the mounting receptacle. When the supply of dosage units within a cartridge is exhausted, that cartridge may be conveniently removed from the mounting receptacle and replaced by another cartridge having a new supply of the same or different ingredients.

16 Claims, 6 Drawing Figures

DOSAGE SEALING, MONITORING AND DISPENSING ASSEMBLY

BACKGROUND OF THE INVENTION

1. Field of the Invention

This invention relates to a dosage sealing, monitoring and dispensing assembly including removable cartridges from which a daily dosage of vitamins, medicines, or the like, can be automatically dispensed to a user over a predetermined length of time.

2. Prior Art

As will be recognized by those skilled in the art, many medicines, drugs, vitamins, and the like are loosely packaged within a container. Once the container is opened, these characteristically hydroscopic dosage units frequently absorb moisture so as to either stick together or spoil. Moreover, relatively large quantities of dosage units are typically supplied in each container. Consequently, a user sometimes fails to consume all of the units before the remaining contents of the container spoil due to age, water absorption or mishandling. As a consequence of the foregoing, many dosage units are uneconomically wasted, such that a fresh supply of dosage units is often unavailable. What is even more, the user has no easy way to keep track of and verify the number of dosage units consumed or remaining. This may pose a significant problem when a predetermined number of such units must be consumed to prevent an under or overdose according to medical requirements.

Because of recent events, most containers in which dosage units are packaged are now attempted to be made either child and/or tamper-proof. Such additional safeguards are known to increase the cost per dosage unit. In addition, many individuals, particularly the elderly, find it increasingly difficult to remove the top from a container which has been made child-resistant. Thus, these individuals may go without their daily dosage of a medically required drug or medicine.

SUMMARY OF THE INVENTION

Briefly, and in general terms, a dosage monitoring and dispensing assembly is disclosed which overcomes the aforementioned problems that are common to conventional containers in which a supply of dosage units is packaged for occasional consumption. The assembly includes a mounting receptacle and one or more removable cartridges which are connected therein. A carefully counted number of dosage units are sealed within moisture impervious shells that are carried on a flexible, segmented bandolier so as to provide the user with a fresh supply of dosage units to last for a predetermined time interval. The bandolier is loaded into a supply cylinder at the interior of a cartridge. The cartridge includes mechanical linkage by which to automatically advance the bandolier from the supply cylinder along a feeding track to a location where the dosage units may be removed, as needed, from the bandolier and dispensed to the user.

The linkage includes a rotatable lever arm which extends between a ratchet and a movable dispensing slide that accessible to the user at the face of the cartridge. A plunger, which is adapted for reciprocal movement through a dispensing orifice, is connected to the lever arm by a pivot. The user depresses the dispensing slide which causes the lever arm to rotate around the pivot and the ratchet to engage and advance the bandolier, until a dosage unit is positioned over the dispensing orifice. As the dispensing slide is depressed further, the plunger is moved downwardly through the bandolier and past the dispensing orifice. Accordingly, a dosage unit is forced from its shell and carried through the dispensing orifice to be delivered to the user either directly or by way of a trough formed in the mounting receptacle.

The underside of the bandolier is printed with a sequence of numbers corresponding to respective ones of the dosage units. Successive numbers of the bandolier move past a window formed in the face of the cartridge each time that the dispensing slide is depressed and the bandolier is advanced. In this way, the user will readily able to keep track of the number of dosage units consumed and thereby avoid overdoses and the unexpected depletion of a fresh supply of units. In the event that the supply of dosage units carried by a cartridge is exhausted, the cartridge may be removed from the mounting receptacle and replaced by another cartridge having a fresh supply of the same or different dosage units.

DESCRIPTION OF THE PREFERRED EMBODIMENT

Figure 1:
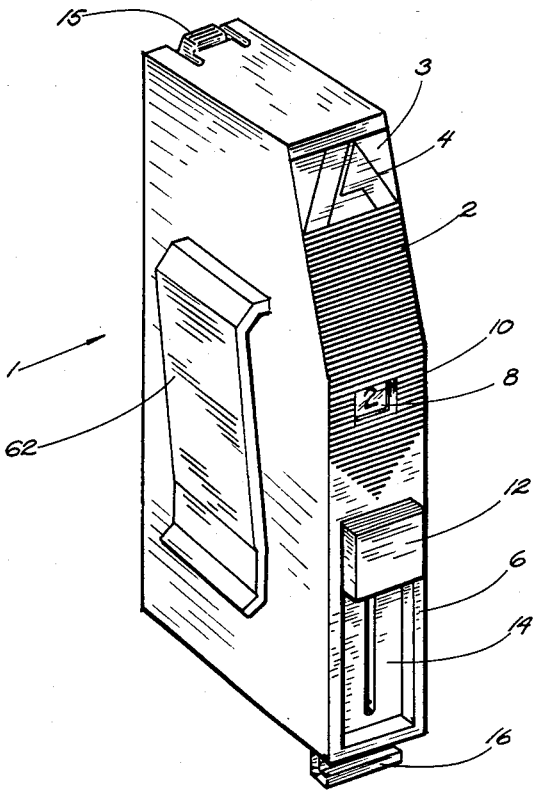
FIG. 1 is an isometric view of a single dosage monitoring and dispensing cartridge which forms the present invention.
Figure 2:
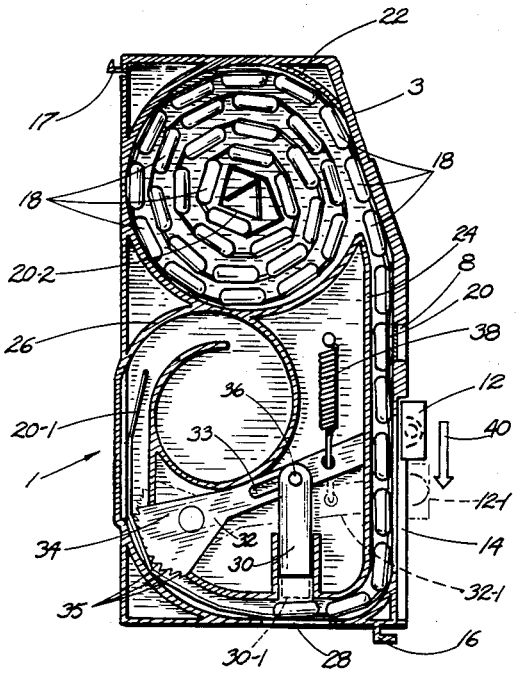
FIG. 2 shows the interior of the cartridge of FIG. 1 with mechanical linkage thereof at rest.
Figure 3:
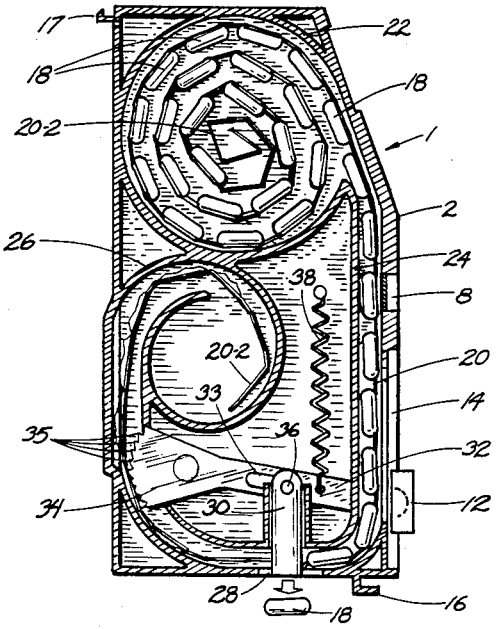
FIG. 3 shows the linkage of FIG. 2 positioning and dispensing dosage units that are carried on a flexible bandolier.
Figure 7:
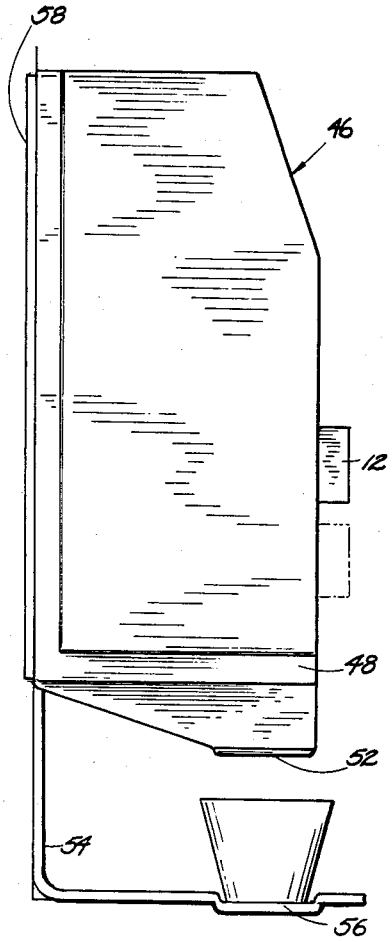
FIG. 7 shows a side view of a mounting receptacle in which the cartridge of FIG. 1 is removable connected.
Figure 8:
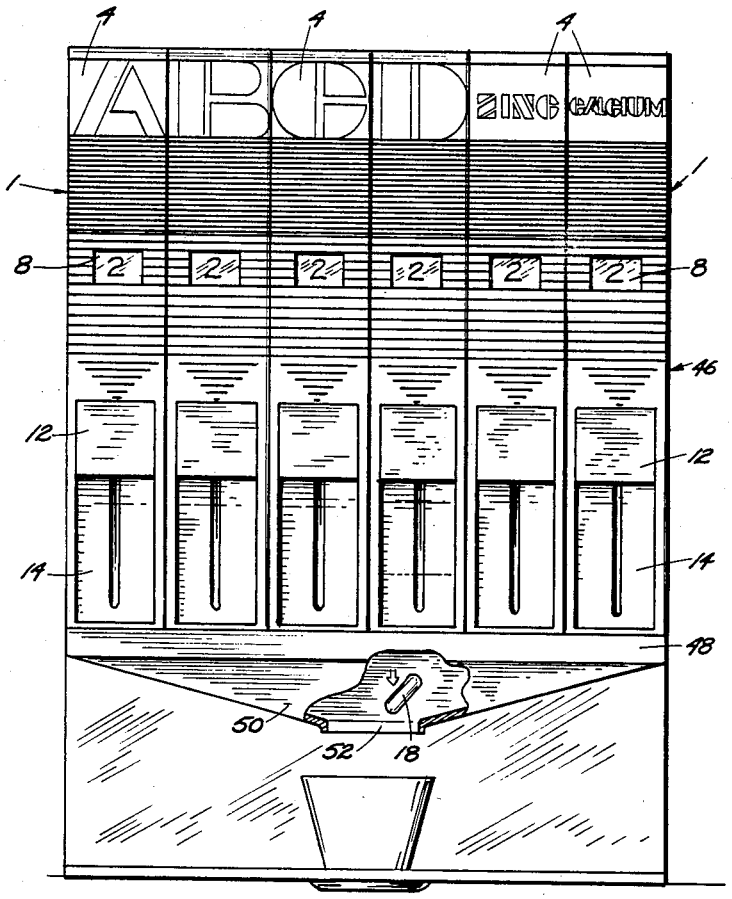
FIG. 8 is a front view of the receptacle of FIG. 7 showing a plurality of dosage unit carrying cartridges removable connected side-by-side therein.
Figure 9:
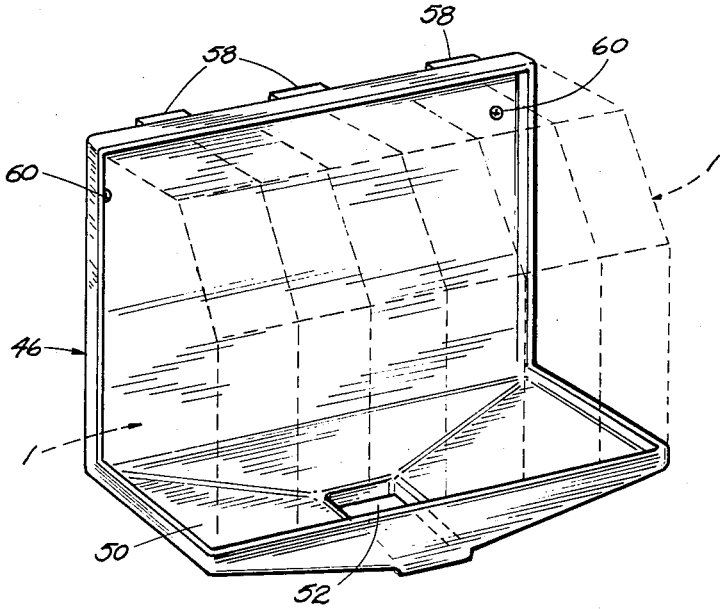
FIG. 9 is an isometric view of the receptacle of FIGS. 7 and 8 with the plurality of cartridges shown in phantom.

The dosage sealing, monitoring and dispensing assembly which forms the present invention is now disclosed while referring concurrently to FIGS. 1–3 of the drawings, where there is shown a single monitoring and dispensing cartridge 1. Cartridge 1 is preferable made from an impact resistant material, such as plastic, or the like, and has a generally rectangular configuration. However, cartridge 1 is provided with an inclined portion 2 including an offset area 3 at which an identification tag 4 may be placed to identify the particular dosage form to be dispensed to the user from cartridge 1. Located at the face 6 of cartridge 1 is a monitoring window 8. A bandolier having a sequence of numbers 10 printed thereon is moved past window 8 so as to provide the user with a visible indication as to the number of dosage units already dispensed from and presently remaining within the cartridge 1. The sequence of numbers 10 may also be used to indicate the number of days during which the dosage units have been consumed. Also located at the face 6 is a dispensing slide 12 and an open slide path 14 through which the dispensing slide 12 may be moved by the user in order to dispense a dosage unit from cartridge 1, in a manner that will be described in greater detail hereinafter. Extending outwardly from the top, bottom and rear of cartridge 1 are conventional snap locks 15, 16 and 17 by which to enable cartridge 1 to be removably connected to a mounting receptacle (best shown in FIGS. 7–9) at which a variety of dosage units is made available to the user.

Referring particularly to FIGS. 2 and 3 of the drawings, details are given of the means by which to selectively dispense dosage units from cartridge 1. Although the dosage units to be supplied herein are ellipsoid-shaped pills 18 (e.g. vitamins, medication, etc.), it is to be expressly understood that this type of dosage from should not constitute a limitation of the present invention, and any other suitable dosage form, whether solid, liquid or gaseous in shape, and including, but not limited to, tablets, capsules, and the like, may be substituted therefor. The pills 18 are sealed within moisture impervious shells carried by a flexible, segmented plastic film or foil strip 20 (best shown in FIG. 4). The flexible strip 20 is rolled into a spiral bandolier and loaded into a dosage supply cylinder 22. Supply cylinder 22 communicates with a feeding track or guide 24 and a take-up cylinder 26. Feeding track 24 passes over a dispensing orifice 28 that is formed in the bottom of cartridge 1 and sized so that a pill 18 may be dispensed therethrough. The underside of the aforementioned bandolier strip 20 is printed with a sequence of numbers 10 which are to be moved past the monitoring window 8, such that each successive segment of the strip is provided with a particular number that corresponds to either a respective pill which is to be dispensed from cartridge 1 or to a day during which such pill is consumed.

The mechanical linkage used for dispensing a pill includes a plunger 30 which is mounted for reciprocal movement in a vertical direction past feeding track 24 and through dispensing orifice 28. Plunger 30 is connected to a lever arm 32 which controls the reciprocal plunger movement. More particularly, the lever arm 32 has a first end connected to the aforementioned dispensing slide 12 and an opposite end connected to a ratchet 34. Ratchet 34 comprises a pair of spaced, opposing ratchet faces (only one of which being visible) having teeth 35 which are dimensioned for receipt in corresponding holes (designated 44 and best shown in FIG. 4) along opposite sides of the strip 20 for advancing strip 20 along feeding track 24 and moving the sequence of numbers 10 at the underside of strip 20 past monitoring window 8 whenever the dispensing slide 12 is depressed by the user.

In order that flexible strip 20 may be advanced between supply cylinder 22 and the takeup cylinder 26 at the same time that an appropriate number from the strip appears in monitoring window 8, strip 20 is provided with leading and trailing portions 20-1 and 20-2 which are devoid of pills. More particularly, the leading portion 20-1 must initially be located in feeding track 24 so that the first pill from the bandolier is positioned in proximity to dispensing orifice 28. The leading portion 20-1 must also be placed in engagement with the teeth 35 of ratchet 34 so that strip 20 will advance a particular distance along feeding track 24 each time the user depresses dispensing slide 12. What is more, the last numbers from the sequence of numbers to be displaced in monitoring window 8 are printed on the underside of trailing portion 20-2. In this manner, when the last pills of the unrolled bandolier are successively moved above dispensing orifice 28, the bandolier will be accurately positioned along track 24 so that the numbers thereof which correspond to such last pills will properly appear in monitoring window 8.

Plunger 30 is connected to the lever arm 32 by a pin 36 which extends transversely through plunger 30 and a slot 33 formed at approximately the mid-point of lever arm 32. Thus, lever arm 32 is adapted to rotate around a pivot established by the interconnection of pin 36 at the slot 33. Because the teeth 35 of ratchet 34 engage the holes along strip 20, a rotation of lever arm 32 causes the strip to be advanced into takeup cylinder 26. The lever arm 32 is also connected to a spring 38 which is normally biased to oppose the downward movement of plunger 30 and the rotational movement of lever arm 32.

The rotational movement of lever arm 32 and the dispensing of a pill 18 are controlled by the dispensing slide 12. That is, the user exerts sufficient force to overcome the bias of spring 38 and move dispensing slide 12 downwardly, in a direction indicated by reference arrow 40, through slide path 14. The downward movement of slide 12 (shown in phantom in FIG. 2 and represented by reference numeral 12-1) causes a corresponding rotation of lever arm 32 in a clockwise direction around pivot pin 36 (shown in phantom in FIG. 2 and represented by the reference numeral 32-1). The downward and corresponding rotational movements of dispensing slide 12 and lever arm 32 stretches spring 38 (best shown in FIG. 3) which normally acts to oppose such downward and rotational movements. The rotational movement of lever arm 32 also causes ratchet 34 to advance the flexible strip 20 a particular, predetermined distance along feeding track 24 such that a pill 18 is positioned between plunger 30 and dispensing orifice 28. The downward movement of dispensing slide 12 to its lower-most position along slide path 14 (as shown in FIG. 3) rotates lever arm 32 a sufficient distance around pivot pin 36 so as to cause plunger 30 to be moved downwardly (shown in phantom in FIG. 2 and represented by the reference numeral 30-1) through dispensing orifice 28 to dislodge an underlying pill 18 from its shell on the strip 20.

Figure 4:
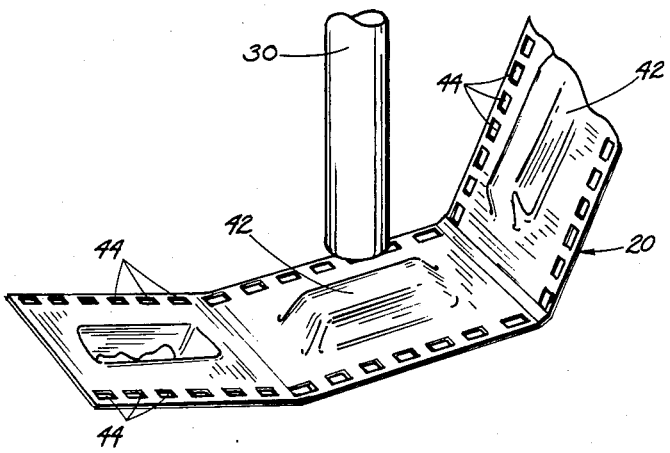
FIGS. 4–6 illustrate details of the present invention for removing a dosage unit from the bandolier and dispensing such unit to the user.
Figure 5:
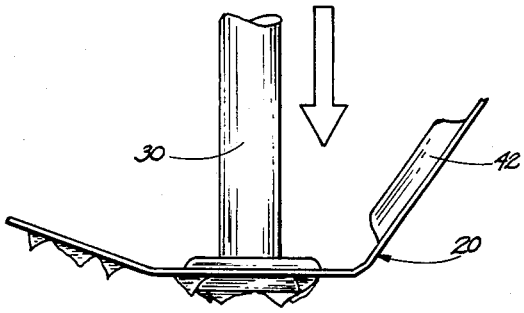
Figure 6:
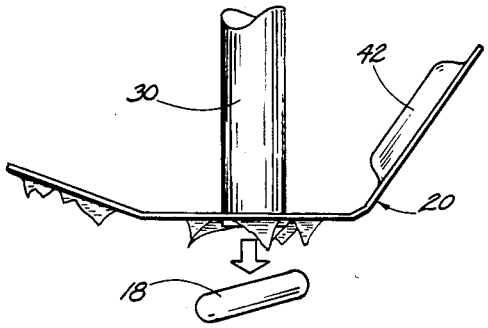

The details of removing a pill 18 from the strip 20 are best described when referring concurrently to FIGS. 4–6 of the drawings. As previously indicated, a plurality of pills 18 are sealed within respective moisture impervious shells 48 along the flexible, segmented strip 20. When the user initially depresses dispensing slide 12 (of FIGS. 1–3) in a downward direction along the slide path 14, the strip 20 is advanced along its feeding track until a shell 42 is disposed under plunger 30 (best illustrated in FIG. 4). As the dispensing slide 12 is moved further along slide path 14, the plunger 30 is moved downwardly and into contact with a shell 42 (best illustrated in FIG. 5). Finally, when the dispensing slide 12 is moved to its lower-most position along slide path 14, the plunger 30 is moved through the shell 42 to force the pill 18 outwardly therefrom (best illustrated in FIG. 5) and through the dispensing orifice 28 (of FIGS. 2 and 3) for delivery to the user. The undersides of the shells 42 may be scored (not shown) to facilitate the removal of the pill 18 therefrom. When the user releases the dispensing slide 12, the bias of spring 38 (of FIGS. 2 and 3) automatically returns the plunger 30 and the slide 12 to their at-rest positions of FIG. 2, so as to be ready for a subsequent pill dispensing operation in a manner as just described.

A mounting receptacle 46 is now disclosed in which to removably connect one or more of the cartridges 1 of FIG. 1 to complete the dosage monitoring and dispensing assembly of the present invention and provide a readily available variety of premeasured and prepackaged dosage forms from which the user may selectively choose. Accordingly, and referring concurrently to FIGS. 7–9 of the drawings, and open-faced mounting receptacle 46 is shown having sufficient area in which to receive a plurality of dispensing cartridges 1. Although, for example, six cartridges are shown located in cabinet 46 of FIG. 8, because of the modular construction of the present monitoring and dispensing assembly, a fewer number of cartridges may be inserted or the cartridges may be rearranged in any order according to the dietary and/or medical needs of the user. Thus, the mounting receptacle 46 is advantageously reusuable, inasmuch as cartridges in which a supply of pills have been depleted may be removed and replaced with a new cartridge containing a fresh supply of either the same or different ingredients. The cartridges 1 are aligned side-by-side, such that the respective dosage identification tags 4 and monitoring windows 8 face outwardly for easy viewing by the user. Likewise, the user will have easy access to a dispensing slide 12 of any cartridge 1 for moving the slide downwardly through the slide path 14 in order to dispense a pill, or the like, as previously disclosed.

Mounting receptacle 46 includes a bottom shelf 48 extending therearound at which to receive and support the cartridges 1. Extending below the bottom shelf 48 is a trough 50 which tapers towards a spout 52 through which a pill 18 is dispensed. The trough 50 and spout 52 are common to all of the cartridges in mounting receptacle 46. Receptacle 46 may also include an optional L-shaped stand or platform 54 (best shown in FIG. 7) having a recess 56 formed therein to receive and locate a cup, or similar container, under the spout 52 or trough 50 for receiving one or more pills 18 from the cartridges 1 or receptacle 46.

The back of mounting receptacle 46 is provided with adhesive backed strips or tabs 58 for conveniently securing the monitoring and dispensing assembly of this invention to any wall or flat surface. As previously indicated, only the cartridges 1, and not the receptacle 46, are, from time to time, removed, rearranged, or replaced. Thus, the receptacle may be permanently affixed to a wall, so that the user will know precisely where to find a premeasured, prepackaged, and fresh supply of pills, or similar dosage forms. Of course, it will be understood that any other conventional fastening means, such as screws or anchors 60, can be used in place of or with the adhesive strips 58 to attach mounting receptacle 46 to a wall or flat surface.

It will be apparent that while a preferred embodiment of the invention has been shown and described, various modifications and changes may be made without departing from the true spirit and scope of the invention. For example, it it to be understood that one or more cartridges 1 may be carried in the user's pocket and/or fastened, by conventional clip means 62 (of FIG. 1), to a belt around the user's waist. Therefore, a cartridge need not be located within mounting receptacle 46 to retain the dosage sealing, monitoring and dispensing characteristics which have been described above. Moreover, each individual cartridge offers the additional advantage at providing a reliable protective and tamper-proof enclosure for the particular dosage forms carried therewithin.

Having thus set forth a preferred embodiment of the present invention, what is claimed is:

1. An assembly for storing and dispensing dosage units, said assembly having at least one cartridge comprising:

means in which to receive a supply of the units to be dispensed;

a dispensing orifice through which the units are delivered to the user;

means for advancing the units from said supply to said dispensing orifice;

actuator means located at a manually accessible position to be operated by the user;

plunger means adapted for reciprocal movement whereby to remove individual units into said dispensing orifice; and lever arms means connected at a first end thereof to said actuator means and at an opposite end thereof to said advancing means, said plunger means being interconnected to said lever arm means intermediate the first and opposite ends thereof, such that the operation of said actuator means simultaneously causes the advancement of units to a position below said plunger means and above said dispensing orifice and the reciprocal movement of said plunger means for delivering units to the user via said orifice.

2. The assembly recited in claim 1, said cartridge further comprising a feeding track extending between said supply and said dispensing orifice, the dosage units being guided along said feeding track from said supply for delivery to said dispensing orifice.

3. The assembly recited in claim 1, wherein said plunger means is adapted for reciprocal movement outwardly from and inwardly through said dispensing orifice for delivering the units through said dispensing orifice depending upon the position of said plunger means relative to said orifice.

4. The assembly recited in claim 3, wherein said lever arm means is pivotally connected to and rotatable around said plunger means for causing the reciprocal movement of said plunger means when the user operates said actuator means.

5. The assembly recited in claim 4, wherein said actuator means includes a handle located exterior of said cartridge to be accessible to the user, said handle being movable by the user for causing said lever arm means to rotate around said plunger means and said plunger means to reciprocate through said dispensing orifice.

6. The assembly recited in claim 4, wherein the supply of dosage units are carried on a flexible strip, said advancing means including ratchet means at the opposite end of said lever arm means, said ratchet means having teeth for engaging said flexible strip and advancing said strip and the units carried thereon to said dispensing orifice when said actuator means is operated and said lever arm means is rotated around said plunger means.

7. The assembly recited in claim 6, wherein the side of said flexible strip opposite the side on which the dosage units are carried has a sequence of numbers appearing thereon, each of said numbers corresponding to a particular unit to be delivered to the user by way of said dispensing orifice.

8. The assembly recited in claim 7, said cartridge further comprising a window formed therein, said flexible strip on which the dosage units are carried being moved past said window such that successive ones of said sequence of numbers are visible in said window when said actuator means is operated and said lever arm means is rotated around said plunger means.

9. The assembly recited in claim 1, including receptacle means for receiving at least one of said cartridges, each cartridge having fastening means for releasably connecting said cartridge to said receptacle means.

10. The assembly recited in claim 9, wherein said receptacle means includes a spout which is common to all of said cartridges received therewithin, said spout delivering dosage units to the user from dispensing orifices of respective cartridges.

11. An assembly for dispensing articles to a user, said assembly comprising:

cartridge means;

a supply of articles carried by a flexible strip and loaded into said cartridge means;

a dispensing orifice formed in said cartridge means through which the articles are delivered to the user;

reciprocating means in said cartridge means adapted for reciprocal movement outwardly from and inwardly through said dispensing orifice; and means for advancing said strip to said dispensing orifice for locating an article on said strip below said reciprocating means and above said orifice while, at the same time, causing said reciprocating means to move inwardly through said orifice to remove an article from said strip for delivery to the user by way of said orifice, said advancing and moving means comprising a lever arm connected to and rotatable around said reciprocating means, one end of said lever arm being connected to an actuator means and the second end of said lever arm being connected to a ratchet, said lever arm rotating around said reciprocating means and thereby causing the reciprocal movement of said reciprocating means relative to said dispensing orifice.

12. The assembly recited in claim 11, further comprising track means in said cartridge means for guiding said strip to said dispensing orifice.

13. The assembly recited in claim 11, wherein said actuator means is located exterior of said cartridge means to be accessible to the user, said actuator means being movable by the user for causing said lever arm to rotate around said reciprocating means and said reciprocating means to reciprocate through said dispensing orifice.

14. The assembly recited in claim 11, wherein said ratchet has teeth for engaging said flexible strip and advancing said strip and the articles carried thereon to said dispensing orifice when said lever arm is rotated around said reciprocating means.

15. The assembly recited in claim 11, wherein said flexible strip on which the articles are carried has a sequence of numbers appearing thereon, each of said numbers corresponding to a particular article to be delivered to the user by way of said cartridge means dispensing orifice, said cartridge means having a window formed therein such that successive ones of said sequence of numbers are visible in said window when said strip is advanced to said orifice past said window.

16. The assembly recited in claim 11, further comprising receptacle means for receiving said cartridge means, said cartridge means including fastening means by which to be releasably connected to said receptacle means.

* * * * *